US009767829B2

(12) United States Patent
Sohn et al.

(10) Patent No.: US 9,767,829 B2
(45) Date of Patent: Sep. 19, 2017

(54) SPEECH SIGNAL PROCESSING APPARATUS AND METHOD FOR ENHANCING SPEECH INTELLIGIBILITY

(71) Applicants: SAMSUNG ELECTRONICS CO., LTD., Suwon-si (KR); YONSEI UNIVERSITY WONJU INDUSTRY-ACADEMIC COOPERATION FOUNDATION, Wonju-si (KR)

(72) Inventors: Jun Il Sohn, Yongin-si (KR); Yun Seo Ku, Seoul (KR); Dong Wook Kim, Seoul (KR); Young Cheol Park, Wonju-si (KR)

(73) Assignees: Samsung Electronics Co., Ltd., Suwon-si (KR); Yonsei University Wonju Industry-Academic Cooperation Foundation, Wonju-si (KR)

( * ) Notice: Subject to any disclaimer, the term of this patent is extended or adjusted under 35 U.S.C. 154(b) by 355 days.

(21) Appl. No.: 14/328,186

(22) Filed: Jul. 10, 2014

(65) Prior Publication Data

US 2015/0081285 A1 Mar. 19, 2015

(30) Foreign Application Priority Data

Sep. 16, 2013 (KR) ..... 10-2013-0111424

(51) Int. Cl.
*G10L 25/93* (2013.01)
*G10L 25/12* (2013.01)
(Continued)

(52) U.S. Cl.
CPC ..... *G10L 25/93* (2013.01); *G10L 21/02* (2013.01); *G10L 21/0224* (2013.01);
(Continued)

(58) Field of Classification Search
CPC ..... G10L 21/0224; G10L 21/0232; G10L 21/0264; G10L 21/0316; G10L 21/057;
(Continued)

(56) References Cited

U.S. PATENT DOCUMENTS 4,219,695 A * 8/1980 Wilkes ..... G10L 25/00 704/217
4,486,900 A * 12/1984 Cox ..... G10L 25/90 704/207
(Continued)

FOREIGN PATENT DOCUMENTS

EP 1 632 935 A1 3/2006

*Primary Examiner* — Eric Yen
(74) *Attorney, Agent, or Firm* — NSIP Law

(57) ABSTRACT

A speech signal processing apparatus and a speech signal processing method for enhancing speech intelligibility are provided. The speech signal processing apparatus includes an input signal gain determiner to determine a gain of an input signal based on a harmonic characteristic of a voiced speech, a voiced speech output unit to output a voiced speech in which a harmonic component is preserved by applying the gain to the input signal, a linear predictive coefficient determiner to determine a linear predictive coefficient based on the voiced speech, and an unvoiced speech preserver to preserve an unvoiced speech of the input signal based on the linear predictive coefficient.

17 Claims, 10 Drawing Sheets

(51) Int. Cl.

| | |
|---|---|
| ***G10L 25/18*** | (2013.01) |
| ***G10L 21/0224*** | (2013.01) |
| ***G10L 19/04*** | (2013.01) |
| ***G10L 21/02*** | (2013.01) |
| ***G10L 21/0232*** | (2013.01) |
| ***G10L 25/15*** | (2013.01) |

(52) U.S. Cl.
CPC ..... *G10L 21/0232* (2013.01); *G10L 25/12* (2013.01); *G10L 25/15* (2013.01); *G10L 19/04* (2013.01)

(58) Field of Classification Search
CPC ..... G10L 25/09; G10L 25/12; G10L 25/78; G10L 2025/783; G10L 25/84; G10L 25/93
See application file for complete search history.

(56) References Cited

U.S. PATENT DOCUMENTS 4,611,342 A * 9/1986 Miller ..... G10L 19/04 341/139
4,771,465 A * 9/1988 Bronson ..... G10L 19/02 704/203
4,797,926 A * 1/1989 Bronson ..... G10L 25/90 704/214
4,913,539 A * 4/1990 Lewis ..... G06T 13/205 352/5
5,081,681 A * 1/1992 Hardwick ..... G10L 19/02 704/268
5,127,054 A * 6/1992 Hong ..... H04B 1/667 704/266
5,347,305 A * 9/1994 Bush ..... G10L 19/00 348/14.01
5,479,522 A * 12/1995 Lindemann ..... H04R 25/356 381/23.1
5,706,395 A * 1/1998 Arslan ..... G10L 21/0208 704/226
5,758,027 A * 5/1998 Meyers ..... G10L 15/02 704/259
5,774,837 A * 6/1998 Yeldener ..... G10L 19/18 704/206
5,890,108 A * 3/1999 Yeldener ..... G10L 19/18 704/200.1
5,893,056 A * 4/1999 Saikaly ..... G10L 19/012 455/223
5,897,615 A * 4/1999 Harada ..... G10L 19/00 704/208
5,915,234 A * 6/1999 Itoh ..... G10L 19/12 704/219
5,950,153 A * 9/1999 Ohmori ..... G10L 21/038 704/217
6,081,777 A * 6/2000 Grabb ..... G10L 21/0364 704/205
6,148,282 A * 11/2000 Paksoy ..... G10L 19/18 704/208
6,173,256 B1 * 1/2001 Gigi ..... G10L 21/0364 704/208
6,240,383 B1 * 5/2001 Tanaka ..... G10L 19/012 704/219
6,240,384 B1 * 5/2001 Kagoshima ..... G10L 13/07 704/220
6,304,842 B1 * 10/2001 Husain ..... G10L 25/00 704/214
6,324,505 B1 * 11/2001 Choy ..... G10L 19/0204 704/201
6,370,500 B1 * 4/2002 Huang ..... G10L 19/012 704/207
6,983,242 B1 * 1/2006 Thyssen ..... G10L 19/22 704/208
7,039,581 B1 * 5/2006 Stachurski ..... G10L 19/20 704/205
8,219,390 B1 * 7/2012 Laroche ..... G10L 21/0272 704/207
2002/0198705 A1 * 12/2002 Burnett ..... G10L 25/78 704/214
2003/0061055 A1 * 3/2003 Taori ..... G10L 19/002 704/500
2003/0115046 A1 * 6/2003 Zinser, Jr. ..... G10L 19/173 704/219
2003/0195745 A1 * 10/2003 Zinser, Jr. ..... H04W 88/181 704/219
2004/0028244 A1 * 2/2004 Tsushima ..... G10L 21/038 381/98
2004/0049380 A1 * 3/2004 Ehara ..... G10L 19/012 704/219
2004/0230428 A1 * 11/2004 Choi ..... G10L 21/0208 704/226
2005/0073986 A1 * 4/2005 Kondo ..... G10L 21/038 370/343
2005/0091048 A1 * 4/2005 Thyssen ..... G10L 19/005 704/223
2005/0114124 A1 * 5/2005 Liu ..... G10L 21/0208 704/228
2005/0143989 A1 * 6/2005 Jelinek ..... G10L 21/0208 704/226
2005/0288921 A1 * 12/2005 Yoshioka ..... G10H 1/0091 704/205
2006/0217984 A1 * 9/2006 Lindemann ..... B60N 2/07 704/268
2008/0140395 A1 * 6/2008 Yeldener ..... G10L 21/0208 704/226
2010/0128897 A1 * 5/2010 Saruwatari ..... G10L 21/028 381/94.3
2011/0004470 A1 * 1/2011 Konchitsky ..... G10L 21/0208 704/226
2011/0007827 A1 * 1/2011 Virette ..... G10L 19/005 375/259
2011/0012830 A1 * 1/2011 Yeh ..... G06F 3/011 345/158
2013/0003989 A1 * 1/2013 Tsang ..... G10L 21/0364 381/102
2013/0151255 A1 * 6/2013 Kim ..... G10L 19/02 704/268

* cited by examiner

SPEECH SIGNAL PROCESSING APPARATUS AND METHOD FOR ENHANCING SPEECH INTELLIGIBILITY

CROSS-REFERENCE TO RELATED APPLICATIONS

This application claims the benefit under 35 USC 119(a) of Korean Patent Application No. 10-2013-0111424 filed on Sep. 16, 2013, in the Korean Intellectual Property Office, the entire disclosure of which is incorporated herein by reference for all purposes.

BACKGROUND

1. Field

The following description relates to a speech signal processing apparatus and method for enhancing speech intelligibility.

2. Description of Related Art

A sound quality enhancing algorithm may be used to enhance the quality of an output sound signal, such as an output sound signal for a hearing aid or an audio system that reproduces a speech signal.

In sound quality enhancing algorithms that are based on estimation of background noise, a tradeoff may occur between a magnitude of residual background noise and speech distortion resulting from a condition of determining a gain value. Thus, when a greater amount of the background noise is removed from an input signal, the speech distortion may be intensified and speech intelligibility may deteriorate.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a speech signal processing apparatus includes an input signal gain determiner configured to determine a gain of an input signal based on a harmonic characteristic of a voiced speech, a voiced speech output unit configured to output voiced speech in which a harmonic component is preserved by applying the gain to the input signal, a linear predictive coefficient determiner configured to determine a linear predictive coefficient based on the voiced speech, and an unvoiced speech preserver configured to preserve an unvoiced speech of the input signal based on the linear predictive coefficient.

The input signal gain determiner may determine the gain of the input signal using a comb filter based on the harmonic characteristic of the voiced speech.

The input signal gain determiner may include a residual signal determiner configured to determine a residual signal of the input signal using a linear predictor, a harmonic detector configured to detect the harmonic component in a spectral domain of the residual signal, a comb filter designer configured to design the comb filter based on the detected harmonic component, and a gain determiner configured to determine the gain based on a result of filtering the input signal using a Wiener filter and a result of filtering the input signal using the comb filter.

The harmonic detector may include a residual spectrum estimator configured to estimate a residual spectrum of a target speech signal included in the input signal in the spectral domain of the residual signal, a peak detector configured to detect peaks in the residual spectrum estimated using an algorithm for peak detection, and a harmonic component detector configured to detect the harmonic component based on an interval between the detected peaks.

The comb filter may be a function having a frequency response in which spikes repeat at regular intervals.

The voiced speech output unit may be configured to output the voiced speech by generating an intermediate output signal by applying the gain to the input signal and performing an inverse short-time Fourier transform (ISTFT) or an inverse fast Fourier transform (IFFT) on the intermediate output signal.

The linear predictive coefficient determiner may be configured to classify the voiced speech into a linear combination of coefficients and a residual signal, and to determine the linear predictive coefficient based on the linear combination of the coefficients.

The unvoiced speech preserver may be configured to preserve an unvoiced speech of the input signal using an all-pole filter based on the linear predictive coefficient.

The all-pole filter may be configured to use a residual spectrum of a target speech signal included in the input signal as excitation signal information input to the all-pole filter.

The apparatus may further include an output signal generator configured to generate a speech output signal based on the voiced speech and the preserved unvoiced speech.

The output signal generator may be configured to generate the speech output signal based on the voiced speech in a section of the input signal in which a zero-crossing rate (ZCR) of the input signal is less than a threshold value, and to generate the speech output signal based on the preserved unvoiced speech in a section of the input signal in which the ZCR of the input signal is greater than or equal to the threshold value.

In another general aspect, a speech signal processing method includes determining a gain of an input signal based on a harmonic characteristic of a voiced speech, outputting the voiced speech in which a harmonic component is preserved by applying the gain to the input signal, determining a linear predictive coefficient based on the voiced speech, and preserving an unvoiced speech of the input signal based on the linear predictive coefficient.

The determining the gain may include using a comb filter based on the harmonic characteristic of the voiced speech.

The determining of the gain of the input signal may include determining a residual signal of the input signal using a linear predictor, detecting the harmonic component in a spectral domain of the residual signal, designing the comb filter based on the detected harmonic component, and determining the gain based on a result of filtering the input signal using a Wiener filter and a result of filtering the input signal using the comb filter.

The detecting of the harmonic component may include estimating a residual spectrum of a target speech signal included in the input signal in the spectral domain of the residual signal, detecting peaks in the residual spectrum estimated using an algorithm for peak detection, and detecting the harmonic component based on an interval between the detected peaks.

The comb filter may be a function having a frequency response in which spikes repeat at regular intervals.

The outputting of the voiced speech may include generating an intermediate output signal by applying the gain to the input signal, and performing an inverse short-time Fourier transform (ISTFT) or an inverse fast Fourier transform (IFFT) on the intermediate output signal.

The determining of the linear predictive coefficient may include classifying the voiced speech into a linear combination of coefficients and a residual signal, and determining the linear predictive coefficient based on the linear combination of the coefficients.

The preserving may include preserving an unvoiced speech of the input signal using an all-pole filter based on the linear predictive coefficient.

The all-pole filter may be configured to use a residual spectrum of a target speech signal included in the input signal as excitation signal information input to the all-pole filter.

The method may further include generating a speech output signal based on the voiced speech and the preserved unvoiced speech.

The generating of the speech output signal may include generating the speech output signal based on the voiced speech in a section of the input signal in which a zero-crossing rate (ZCR) of the input signal is less than a threshold value, and generating the speech output signal based on the preserved unvoiced speech in a section of the input signal in which the ZCR of the input signal is greater than or equal to the threshold value.

In another general aspect, a non-transitory computer-readable storage medium stores a program for speech signal processing, the program including instructions for causing a computer to perform the method presented above.

In another general aspect, a speech signal processing apparatus, includes an input signal classifier configured to classify an input signal into a voiced speech and an unvoiced speech, a voiced speech output unit configured to output the voiced speech in which a harmonic component is preserved by applying a gain that is determined based on a harmonic characteristic of the voiced speech to the input signal, and an unvoiced speech preserver configured to preserve the unvoiced speech of the input signal based on a linear predictive coefficient.

The gain may be determined using a comb filter based on a harmonic characteristic of the voiced speech.

The unvoiced speech may be preserved using an all-pole filter based on the linear predictive coefficient.

The input signal classifier may include at least one of a voiced and unvoiced speech discriminator and a voiced activity detector (VAD).

The input signal classifier may be further configured to determine whether a portion of the input signal is a noise section or a speech section based on a spectral flatness of the portion of the input signal.

The apparatus may further include an output signal generator configured to generate a speech output signal based on the voiced speech and the preserved unvoiced speech.

Other features and aspects will be apparent from the following detailed description, the drawings, and the claims.

Figure 1:
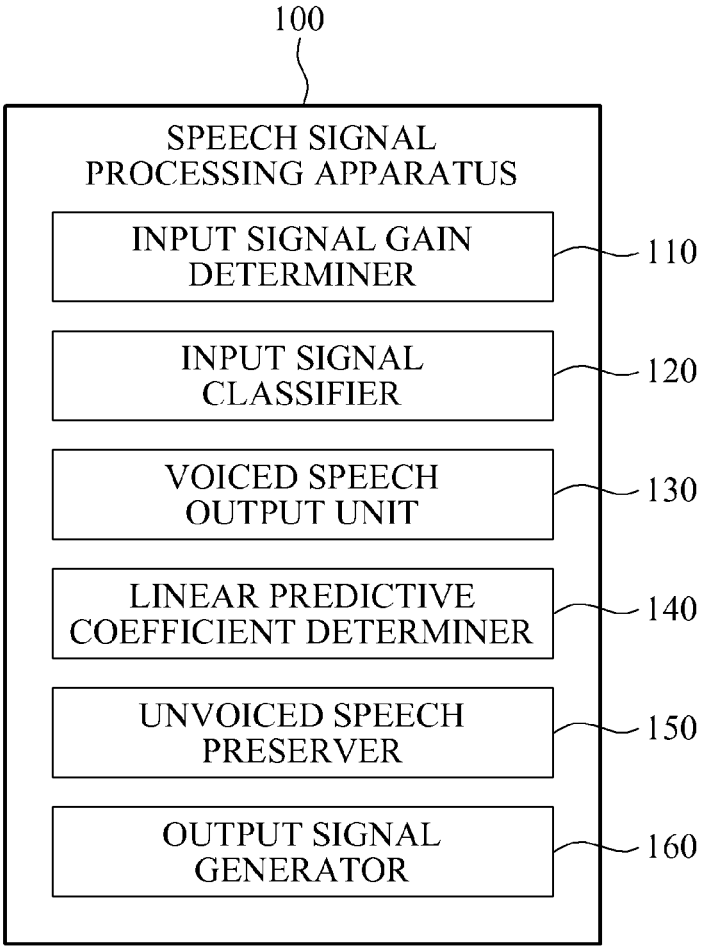
FIG. 1 is a diagram illustrating an example of a configuration of a speech signal processing apparatus.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Examples address the issues related to tradeoffs between minimizing speech distortion and background noise. Thus, examples enhance speech intelligibility of an output signal by minimizing speech distortion and removing background noise.

FIG. 1 is a diagram illustrating an example of a configuration of a speech signal processing apparatus 100.

Referring to the example of FIG. 1, the speech signal processing apparatus 100 includes an input signal gain determiner 110, an input signal classifier 120, a voiced speech output unit 130, a linear predictive coefficient determiner 140, an unvoiced speech preserver 150, and an output signal generator 160.

In an example, the speech signal processing apparatus 100 is included in a hearing loss compensation apparatus to compensate for hearing limitations of people with hearing impairments. In such an example, the speech signal processing apparatus 100 processes speech signals collected by a microphone of the hearing loss compensation apparatus.

Also, in another example, the speech signal processing apparatus 100 is included in an audio system reproducing speech signals.

In the example of FIG. 1, the input signal gain determiner 110 determines a gain of an input signal using a comb filter based on a harmonic characteristic of a voiced speech. A comb filter is a signal processing technique that adds a delayed version of a signal to itself, causing constructive and destructive interferences. In an example, the comb filter employs a function having a frequency response in which spikes repeat at regular intervals. By using such a comb filter, an example obtains information about the characteristics of the input signal that is used to enhance speech intelligibility, as is discussed further below.

A detailed configuration and an operation of the input signal gain determiner 110 are further described with reference to FIG. 2.

In the example of FIG. 1, the input signal classifier 120 classifies the input signal into a voiced speech and an unvoiced speech.

For example, the input signal classifier 120 determines whether a present frame of the input signal is a noise section using a voiced and unvoiced speech discriminator and a voiced activity detector (VAD). Such a VAD uses techniques in speech processing in which the presence or absence of speech is detected. Various algorithms for the VAD provide various tradeoffs between factors such as performance and resource usage. In response to the present frame being determined not to be included in the noise section, a speech included in the present frame may be classified as the voiced speech or the unvoiced speech. Thus, a present frame that is not noise is considered to be some form of speech.

The input signal may be represented by Equation 1.

$$y(n)=x(n)+w(n) \quad \text{Equation 1}$$

In Equation 1, "y(n)" denotes an input signal in which noise and a speech are mixed. Such an input signal is the input signal that is to be processed to help isolate the speech signal. Accordingly "x(n)" and "w(n)" denote a target speech signal and a noise signal, respectively.

In another example, the input signal is divided into a linear combination of coefficients and a residual signal "$v_y(n)$" through linear prediction. In such an example, a pitch of the speech in the present frame is potentially calculated by using the coefficients in an autocorrelation function calculation.

For example, the residual signal is transformed into a residual spectrum domain through a short-time Fourier transform (STFT), as represented by Equation 2. In such an example, when the input signal classifier 120 indicates a ratio "γ(k, l)" of an input spectrum "Y(k,l)" to a residual signal spectrum "$V_y(k,l)$" as a decibel (dB) value, the dB value is a value of spectral flatness.

$$\gamma(k,l)=\Sigma_k|Y(k,l)|^2/\Sigma_k|V_y(k,l)|^2 \quad \text{Equation 2}$$

In the example of FIG. 1, the input signal classifier 120 determines whether the present frame is the noise section or a speech section in which a speech is present based on the value of spectral flatness. The derivation of the value of spectral flatness has been discussed, above.

When the current value of spectral flatness is less than a threshold value or a mean value of past values judged to indicate a spectral flatness, the input signal classifier 120 determines the present frame to be part of the noise section. Conversely, when the value of spectral flatness is greater than or equal to the threshold value or the mean value of the past values judge to indicate the spectral flatness, the input signal classifier 120 determines the present frame to be the speech section. For example, when the present frame has a higher value of the spectral flatness compared to other frames, the input signal classifier 120 may determine the present frame to be the speech section. On the other hand, when the present frame has a lower value of the spectral flatness compared to other frames, the input signal classifier 120 may determine the present frame to be the noise section However, using a threshold or a mean are only two suggested bases of comparison for classifying the input signal, and other examples use other information and/or approaches.

Also, in an example, the input signal classifier divides a speech into the voiced speech and the unvoiced speech based on a presence or absence of a vibration in vocal cords.

When the present frame is determined to be in the speech section, the input signal classifier 120 determine whether the present frame is the voiced speech or the unvoiced speech. As another example, the input signal classifier 120 determines whether the present frame is the voiced speech or the unvoiced speech based on speech energy and a zero-crossing rate (ZCR). Zero-crossing rate is the rate of sign changes of the speech signal. This feature can be used to help decide whether a segment of speech is voice or unvoiced.

In an example, the unvoiced speech is likely to have a characteristic of white noise, and as a result has low speech energy and a high ZCR. Conversely, the voiced speech, which is a periodic signal, has relatively high speech energy and a low ZCR. Thus, when the speech energy of the present frame is less than a threshold value or the present frame has a ZCR greater than or equal to a threshold value, the input signal classifier 120 determine the present frame to be the unvoiced speech. Similarly, when the speech energy of the present frame is greater than or equal to the threshold value or the present frame has a ZCR less than the threshold value, the input signal classifier 120 determines the present frame to be the voiced speech.

In the example of FIG. 1, the voiced speech output unit 130 outputs the voiced speech in which a harmonic component is preserved by applying the gain determined by the input signal gain determiner 110 to the input signal. The voiced speech in which the harmonic component is preserved corresponds to the voiced speech of the input signal classified by the input signal classifier 120.

The voiced speech output unit 130 outputs the voiced speech $\hat{x}_v(n)$ in which the harmonic component is preserved. The harmonic component is preserved by generating an intermediate output signal by applying the gain determined by the input signal gain determiner 110 to the input signal and by performing an inverse short-time Fourier transform (ISTFT) or an inverse fast Fourier transform (IFFT).

For example, the voiced speech output unit 130 generates the intermediate output signal $\hat{X}_v(k,l)$ based on Equation 3.

$$\hat{X}_v(k,l)=Y(k,l)H_c(k,l) \quad \text{Equation 3}$$

In Equation 3, "Y(k,l)" indicates an input spectrum obtained by performing a short-time Fourier transform (STFT) on the input signal. In an example, "$H_c(k,l)$" denotes one of the gain determined by the input signal gain determiner 110 and the comb filter gain used by the input signal gain determiner 110. However, in other examples, other techniques are used to derive a gain value for "$H_c(k,l)$" for use in Equation 3.

The voiced speech output unit 130 transmits the voiced speech $\hat{x}_v(n)$ in which the harmonic component is preserved to the linear predictive coefficient determiner 140.

The linear predictive coefficient determiner 140 determines a linear predictive coefficient to be used by the unvoiced speech preserver 150 based on the voiced speech $\hat{x}_v(n)$ in which the harmonic component is preserved. In an example, the linear predictive coefficient determiner 140 is a linear predictor performing linear predictive coding (LPC). However, other examples of the linear predictive coefficient determiner 140 use other techniques than LPC to determine the linear predictive coefficient.

In FIG. 1, the linear predictive coefficient determiner 140 receives the voiced speech $\hat{x}_v(n)$ in which the harmonic component is preserved from the voiced speech output unit 130.

Additionally, in an example, the linear predictive coefficient determiner 140 separates the received voiced speech $\hat{x}_v(n)$ into a linear combination of coefficients and a residual signal as represented in Equation 4, and determines the linear predictive coefficient based on the linear combination of the coefficients.

$$\hat{x}_v(n) = -\Sigma_{i=1}^{p} a_i^c \hat{x}_v(n-i) + v_{\hat{x}_v}(n) \quad \text{Equation 4}$$

In Equation 4, $\hat{x}_v(n)$, in an example, is IFFT[$\hat{X}_v(k,l)$] obtained by performing the IFFT on the intermediate output signal $\hat{X}_v(k,l)$, and a time-domain signal of the intermediate output signal $\hat{X}_v(k,l)$. Also, $v_{\hat{x}_v}(n)$ denote the residual signal, and $a_i^c$ denotes the linear predictive coefficient.

The unvoiced speech preserver 150 configures an all-pole filter based on the linear predictive coefficient determined by the linear predictive coefficient determiner 140. By using the all-pole filter, the unvoiced speech preserver 150 preserves the unvoiced speech of the input signal. An all-pole filter has a frequency response function that goes infinite (poles) at specific frequencies, but there are no frequencies where the response function is zero. For example, the all-pole filter uses a residual spectrum of a target speech signal included in the input signal as excitation signal information input to the all-pole filter.

In comparison to the voiced speech, the unvoiced speech typically has lower energy and other characteristics similar to white noise. Also, in comparison to the voiced speech having high energy in a low frequency band, the unvoiced speech typically has energy relatively concentrated in a high frequency band. Further, the unvoiced speech is potentially an aperiodic signal and thus, the comb filter is potentially less effective in enhancing a sound quality of the unvoiced speech.

Accordingly, the unvoiced speech preserver 150 estimates an unvoiced speech component of the target speech signal using the all-pole filter based on the linear predictive coefficient determined based on the gain determined using the comb filter.

As represented by Equation 5, the unvoiced speech preserver 150 outputs the unvoiced speech $\hat{x}_{uv}(n)$ of the input signal using the residual spectrum $\hat{v}_x(n)$ of the target speech signal included in the input signal as the excitation signal information input to the all-pole filter "G." In this example, the residual spectrum is the residual signal of a target speech estimated in the residual domain.

$$\hat{x}_{uv}(n) = G\hat{v}_x(n) \quad \text{Equation 5}$$

As represented by Equation 6, the all-pole filter G is potentially obtained based on the linear predictive coefficient $a_i^c$ determined by the linear predictive coefficient determiner 140.

$$G = \frac{1}{1 + \sum_{i=1}^{p} a_i^c z^{-i}} \quad \text{Equation 6}$$

The unvoiced speech preserver 150 processes the unvoiced speech of the input signal using the linear predictive coefficient of the voiced speech in which the harmonic component is preserved by the voiced speech output unit 130. Thus, the unvoiced speech preserver 150 obtains a more natural sound closer to the target speech because it is able to retain harmonic components, improving speech intelligibility. Also, the unvoiced speech preserver 150 processes the unvoiced speech of the input signal using the linear predictive coefficient of the voiced speech in which the harmonic component is preserved by the voiced speech output unit 130 and therefore, a signal distortion is less likely to occur in comparison to other sound quality enhancing technologies, and unvoiced speech components having low energy is preserved.

The output signal generator 160 generates a speech output signal based on the voiced speech output provided to it by the voiced speech output unit 130 and the unvoiced speech output provided to it by the unvoiced speech preserver 150.

The output signal generator 160 generates the speech output signal, based on the voiced speech in which the harmonic component is preserved, in a section in which a ZCR of the input signal is less than a threshold value. The output signal generator 160 may generate the speech output signal based on the preserved unvoiced speech in a section in which the ZCR of the input signal is greater than or equal to the threshold value. Thus, the ZCR serves as information that helps discriminate which parts of the signal are to be considered voiced speech and which parts of the signal are to be considered preserved unvoiced speech.

For example, the output signal generator 160 generates the speech output signal based on Equation 7.

$$\hat{x}_{out}(n) = \begin{cases} \hat{x}_v(n) & \text{if zero crossing rate} < \sigma_v \\ \hat{x}_{uv}(n) & \text{if zero crossing rate} \geq \sigma_v \end{cases} \quad \text{Equation 7}$$

In the example of Equation 7, "σv" denotes a threshold value determining a voiced speech and an unvoiced speech. $\hat{x}_v(n)$ and $\hat{x}_{uv}(n)$ denote the voiced speech output by the voiced speech output unit 130 and the unvoiced speech preserved by the unvoiced speech preserver 150, respectively.

Thus, the speech signal processing apparatus 100 processes a speech signal based on different characteristics between the voiced speech and the unvoiced speech. Accordingly, the speech signal processing apparatus 100 effectively preserve the unvoiced speech components having the harmonic components corresponding to the voiced speech and the characteristics of white noise, and at the same time effectively reduce background noise. Accordingly, the speech signal processing apparatus 100 enhances speech intelligibility.

Figure 2:
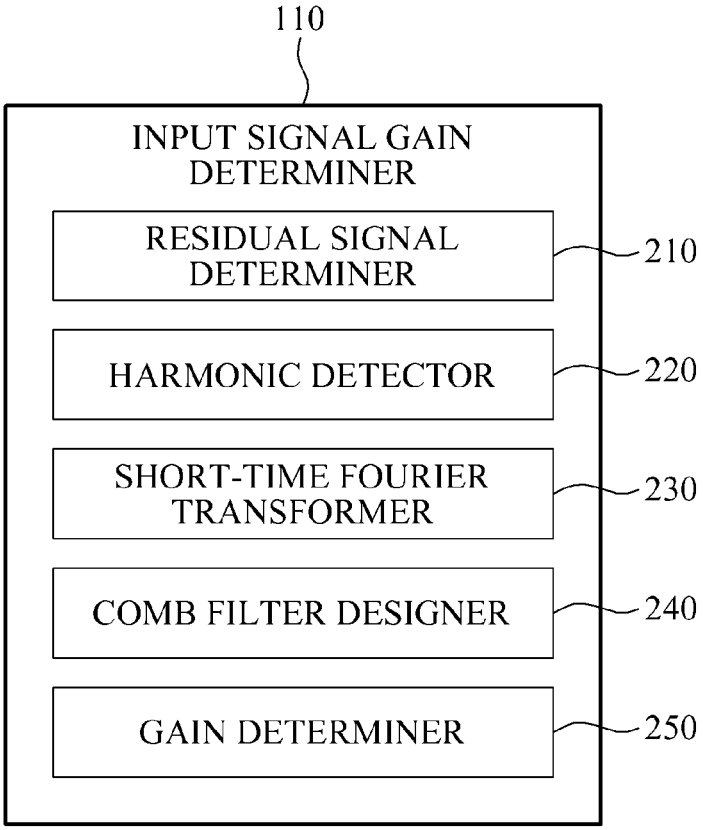
FIG. 2 is a diagram illustrating an example of a configuration of an input signal gain determiner.

FIG. 2 is a diagram illustrating an example of a configuration of the input signal gain determiner 110 of FIG. 1.

Referring to the example of FIG. 2, the input signal gain determiner 110 includes a residual signal determiner 210, a harmonic detector 220, a short-time Fourier transformer 230, a comb filter designer 240, and a gain determiner 250.

In the example of FIG. 2, the residual signal determiner 210 determines a residual signal of an input signal through linear prediction.

The harmonic detector 220 detects a harmonic component from a spectral domain of the residual signal determined by the residual signal determiner 210.

The configuration and operation of the harmonic detector 220 are further described with reference to FIG. 3.

In an example, the short-time Fourier transformer 230 performs a short-time Fourier transform (STFT) on each of the input signal and the residual signal, and outputs an input spectrum and a residual signal spectrum, respectively. Such a Fourier transform is used to determine the sinusoidal frequency and phase content of local sections of a signal as the signal changes over time.

The comb filter designer 240 designs a comb filter for signal processing based on the harmonic component detected by the harmonic detector 220.

For example, the comb filter designer 240 designs the comb filter to output a comb filter gain "$H_c(k)$" as represented by Equation 8.

$$H_c(k) = \begin{cases} B_c e^{-\frac{z(k-k_c)^2}{c}} & k \in [k_c - k_0/2, k_c + k_0/2] \\ B_k & \text{otherwise} \end{cases} \quad \text{Equation 8}$$

In the example of Equation 8, "$k_c$" denotes the harmonic component detected by the harmonic detector 220, and "$k_0$" denotes a fundamental frequency of a present frame of the input signal.

Also in this example, "$B_c(k)$" denotes a filter weight value, and "$B_k(k)$" denotes a gain value designed using a Wiener filter. A Wiener filter produces an estimate of a desired random process by linear time-invariant filtering an observed noisy process, assuming known stationary signal and noise spectra, and additive noise. The Wiener filter minimizes the mean square error between the estimated random process and the desired process. Here, $B_k(k)$ is optionally applied to other sections in lieu of the harmonic component. $B_c(k)$ and $B_k(k)$ are represented by Equations 9 and 10, respectively.

$$B_c(k) = \frac{E[|\hat{X}(k)|^2]}{E[|Y(k)|^2]} \quad \text{Equation 9}$$

$$B_k(k) = \frac{\xi(k)}{1 + \xi(k)} \quad \text{Equation 10}$$

In Equation 10, $\xi(k)$ is represented, in an example, by Equation 11.

$$\xi(k) = \frac{E[|\hat{X}(k)|^2]}{E[|W(k)|^2]} \quad \text{Equation 11}$$

For example, the comb filter designed by the comb filter designer 240 indicates a function having a frequency response in which spikes repeat at regular intervals, and the comb filter is effective in preventing deletion of harmonic components repeating at regular intervals during a filtering process. Thus, the comb filter designed by the comb filter designer 240 avoids limitations of a general algorithm for noise estimation that produce a gain that removes the harmonic components having low energy. When the harmonic components are removed, the speech becomes less intelligible.

In an example, the gain determiner 250 determines the gain of the input signal based on a Wiener filter gain obtained as a result of filtering the input signal using a Wiener filter and a comb filter gain obtained as a result of filtering the input signal using the comb filter designed by the comb filter designer 240. In such an example, the Wiener filter gain is obtained using a single channel speech enhancement algorithm.

Thus, in this example, the input signal gain determiner 110 designs the comb filter based on the harmonic characteristic of the voiced speech by detecting harmonic components in the residual spectrum of the target speech signal, combining the gain obtained using the designed comb filter and the gain obtained using the Wiener filter, and forming a gain that minimizes a distortion of the harmonic components of a speech and at the same time, sufficiently removes background noise.

Figure 3:
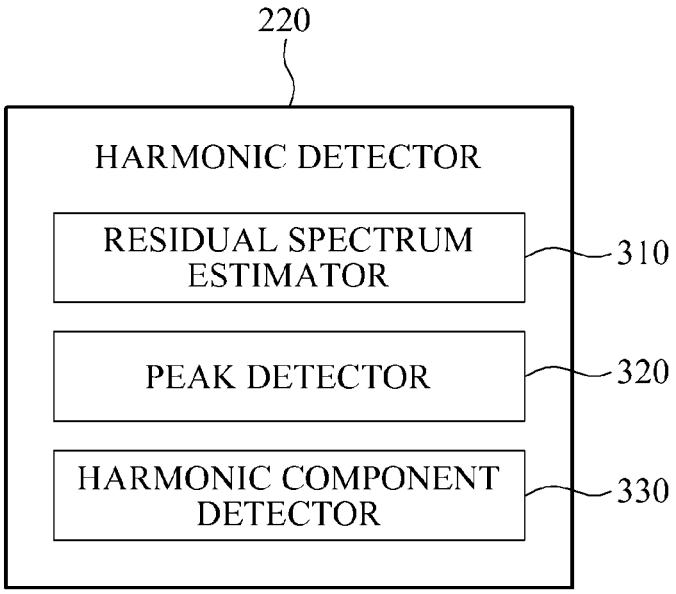
FIG. 3 is a diagram illustrating an example of a harmonic detector.

FIG. 3 is a diagram illustrating an example of the harmonic detector 220 of FIG. 2.

Referring to the example of FIG. 3, the harmonic detector 220 includes a residual spectrum estimator 310, a peak detector 320, and a harmonic component detector 330.

For example, the residual spectrum estimator 310 estimates a residual spectrum of a target speech signal included in an input signal in a spectral domain of a residual signal determined by the residual signal determiner 210 of FIG. 2. Due to the influence of frequency flatness, detection of a harmonic component present in noise of the residual spectrum is potentially simpler by comparison to detection in a frequency domain of a signal.

The peak detector 320 detects, using an algorithm for peak detection, peaks in the residual spectrum estimated by the residual spectrum estimator 310.

The harmonic component detector 330 detects the harmonic component, as discussed above, based on an interval between the peaks detected by the peak detector 320.

For example, when the interval between the peaks detected by the peak detector 320 is less than 0.7 $k_0$, where $k_0$ is defined as above, the harmonic component detector 330 considers the peaks detected by the peak detector 320 to be peaks caused by noise and delete such peaks.

As another example, when the interval between the peaks detected by the peak detector 320 is greater than 1.3 $k_0$, the harmonic component detector 330 infers that a disappearing harmonic component is present between the peaks detected by the peak detector 320 and detects the disappearing harmonic component using an integer multiple of a fundamental frequency.

Figure 4:
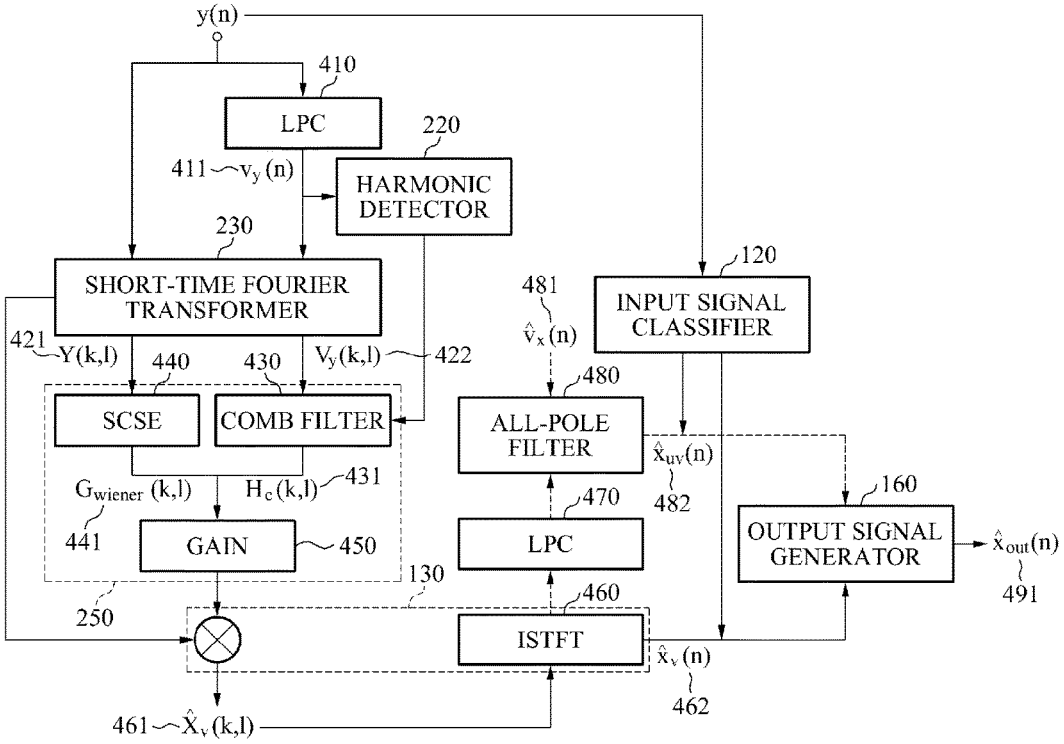
FIG. 4 is a diagram illustrating an example of information flow in a speech signal processing process.

FIG. 4 is a diagram illustrating an example of a flow of information in a speech signal processing process. The discussion below pertains to the operation of various components operating in an example, and is intended to be illustrative rather than limiting.

The residual signal determiner 210 of the input signal gain determiner 110 illustrated in FIGS. 1 and 2 performs an LPC 410 on an input signal "y(n)" using a linear predictor and outputs a residual signal "$v_y(n)$" 411 of the input signal.

The harmonic detector 220 illustrated in FIGS. 2 and 3 estimates a residual spectrum of a target speech signal included in the input signal in a spectral domain of the residual signal 411. Further, the harmonic detector 220 detects harmonic components in the estimated residual spectrum. Also, the comb filter designer 240 of FIG. 2 designs a comb filter 430 based on the harmonic components detected by the harmonic detector 220.

The short-time Fourier transformer 230 performs an STFT on each of the input signal and the residual signal, and outputs an input spectrum "Y(k,l)" 421 and a residual signal spectrum "$V_y(k,l)$" 422.

The comb filter 430 designed based on the harmonic components detected by the harmonic detector 220 outputs a comb filter gain "$H_c(k,l)$" 431 obtained by filtering the residual signal spectrum 422.

Also, in an example, a standard common subexpression elimination "SCSE" 440, which is a type of single channel Wiener filter, filters the input spectrum 421 and outputs a Wiener filter gain "$G_{wiener}(k,l)$" 441.

The gain determiner 250 of FIG. 2 determines a gain 450 of the input signal by combining the comb filter gain 431 and the Wiener filter gain 441.

The input signal classifier 120 of FIG. 1 classifies the input signal into a voiced speech and an unvoiced speech, as discussed above.

The voiced speech output unit 130 of FIG. 1 generates an intermediate output signal "$\hat{X}_v(k,l)$" 461 by applying the gain 450 to the input signal.

The voiced speech output unit 130 performs an ISTFT on the intermediate output signal 461 by using an inverse short-time Fourier transformer 460 and outputs a voiced speech "$\hat{x}_v(n)$" 462 classified by the input signal classifier 120.

The voiced speech output unit 130 transmits the voiced speech 462 to the linear predictive coefficient determiner 140 of FIG. 1.

Subsequently, the linear predictive coefficient determiner 140 performs an LPC 470 on the voiced speech 462 using a linear predictor and determine a linear predictive coefficient $a_i^c$.

The linear predictive coefficient determiner 140 classifies the received voiced speech 462 into a linear combination of coefficients and a residual signal as shown in Equation 4, and determines the linear predictive coefficient based on the linear combination of the coefficients.

The unvoiced speech preserver 150 of FIG. 1 configures an all-pole filter 480 based on the linear predictive coefficient determined by the linear predictive coefficient determiner 140, and preserves an unvoiced speech of the input signal using the all-pole filter 480.

The unvoiced speech preserver 150 uses the residual spectrum "$\hat{v}_x(n)$" 481 of the target speech signal included in the input signal as excitation information input to the all-pole filter 480, and outputs the unvoiced speech "$\hat{x}_{uv}(n)$" 482 of the input signal.

The output signal generator 160 of FIG. 1 generates a speech output signal "$\hat{x}_{out}(n)$" 491 based on the voiced speech 462 output by the voiced speech output unit 130 and the unvoiced speech 482 output by the unvoiced speech preserver 150. The output signal generator processes the voiced speech 462 and the unvoiced speech 482, for example, using ZCR information.

In a section in which a ZCR of the input signal is less than a threshold value, the output signal generator 160 may generate the speech output signal 491 by selecting the voiced speech 462. Conversely, in a section in which the ZCR of the input signal is greater than or equal to the threshold value, the output signal generator 160 may generate the speech output signal 491 by selecting the unvoiced speech 482.

Figure 5A:
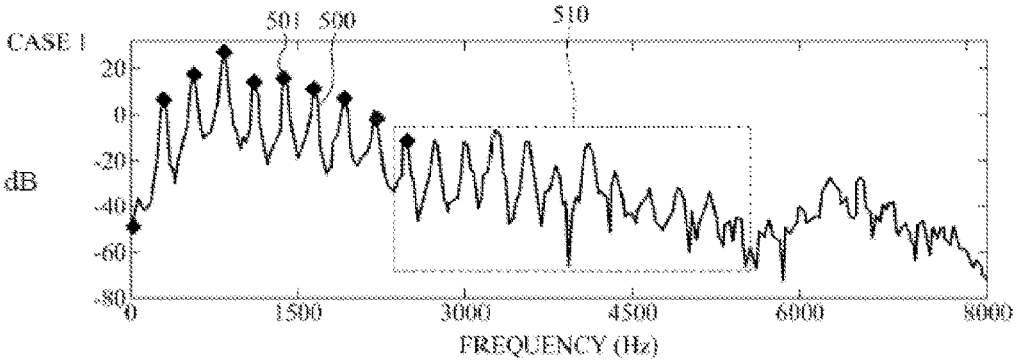
FIGS. 5A and 5B are diagrams illustrating examples of results of harmonic detection.
Figure 5B:
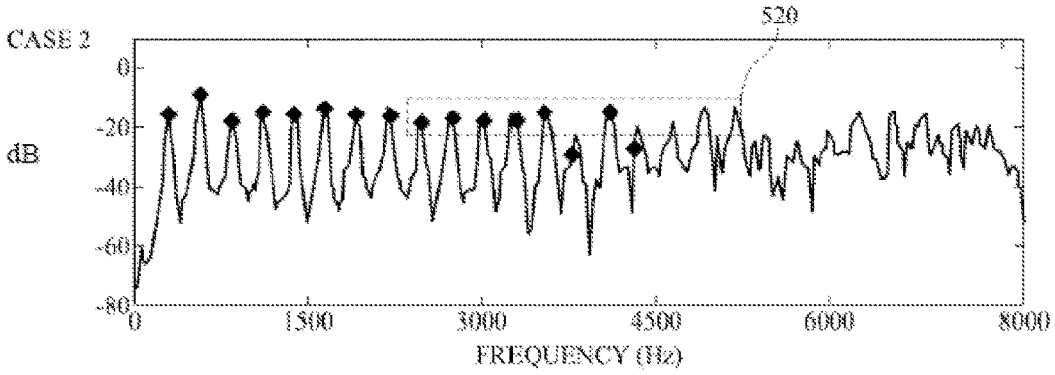

FIGS. 5A and 5B are diagrams illustrating examples of results of harmonic detection.

Referring to FIG. 5A, case 1 indicates a result of detecting a harmonic component in a frequency domain signal 500 according to related art. Referring to FIG. 5B, case 2 indicates a result of detecting a harmonic component in a residual signal spectrum using the harmonic detector 220, example of which are illustrated in FIGS. 2 and 3. Referring to FIGS. 5A and 5B, case 1 and case 2 illustrate the results obtained by applying an algorithm for peak detection under an identical condition of a signal to noise ratio (SNR) of 5 decibel (dB) of a speech input signal to which white noise is applied.

In FIG. 5A, the frequency domain signal 500 includes peaks as illustrated in case 1 . The related art may detect, as the harmonic component, at least one peak 501 from among the peaks in the frequency domain signal 500. However, as illustrated in case 1 , the peaks in a band 510 between 2 kilohertz (kHz) and 4 kHz have lower energy than the peak 501 and thus, the peaks in the band 510 may not be detected as the harmonic component.

As illustrated in FIG. 5B, in case 2 , a difference in energy between the peaks is smaller in the residual signal spectrum in comparison to the frequency domain signal 500. Accordingly, in this example, the harmonic detector 220 is able to detect, as the harmonic component, the peaks included in a band 520 between 2 kHz and 4 kHz.

Figure 6:
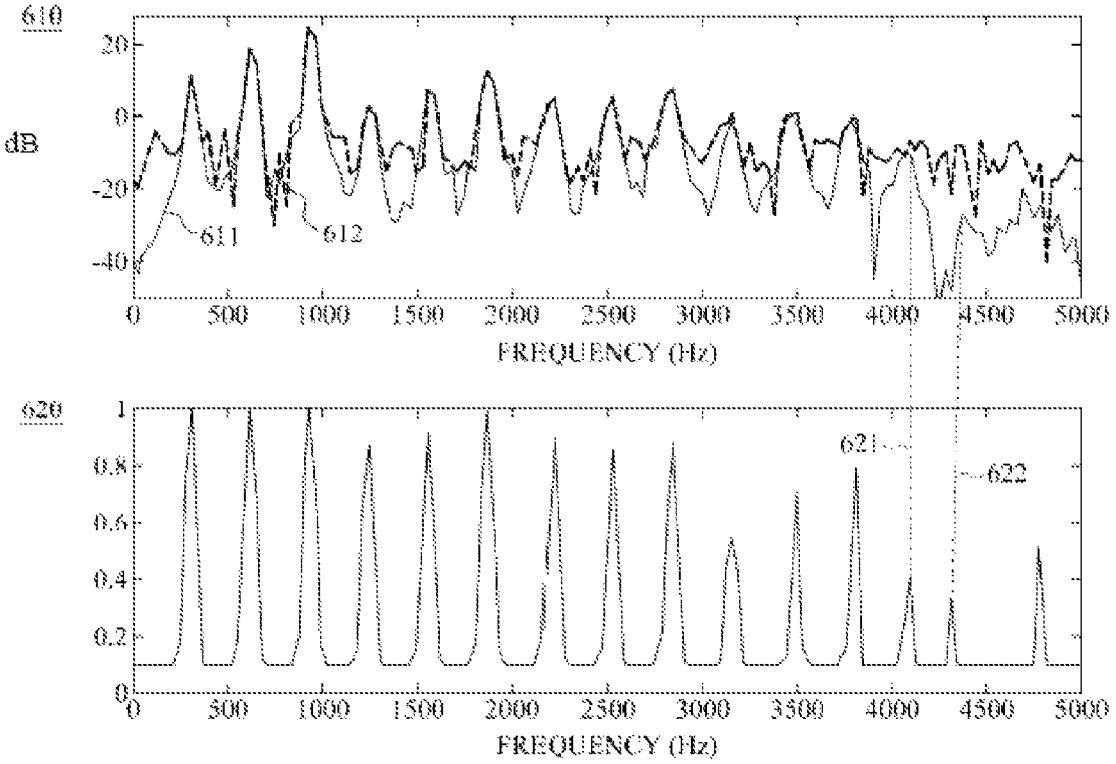
FIG. 6 is a diagram illustrating an example of a comb filter gain obtained as a result of filtering using a comb filter.

FIG. 6 is a diagram illustrating an example of a comb filter gain 620 obtained as a result of filtering using a comb filter.

FIG. 6 illustrates a spectrum 610 of a voiced speech section in which voiced speeches are included in an input signal and the comb filter gain 620 obtained as the result of filtering using the comb filter.

Referring to FIG. 6, the spectrum 610 of the voiced speech section indicates a noisy speech spectrum 612 including noise added to a target speech spectrum 611. Peaks, for example, 621 and 622, of the target speech spectrum 611, are buried by the noise of the noisy speech spectrum 612.

In this example, the comb filter designed by the comb filter designer 240 of FIG. 2 restores harmonic components repeating at regular intervals. Accordingly, the comb filter gain 620 obtained as the result of the filtering using the comb filter prevents the peak 621 and the peak 622 buried by the noise due to low energy from being considered as noise and being deleted.

Figure 7:
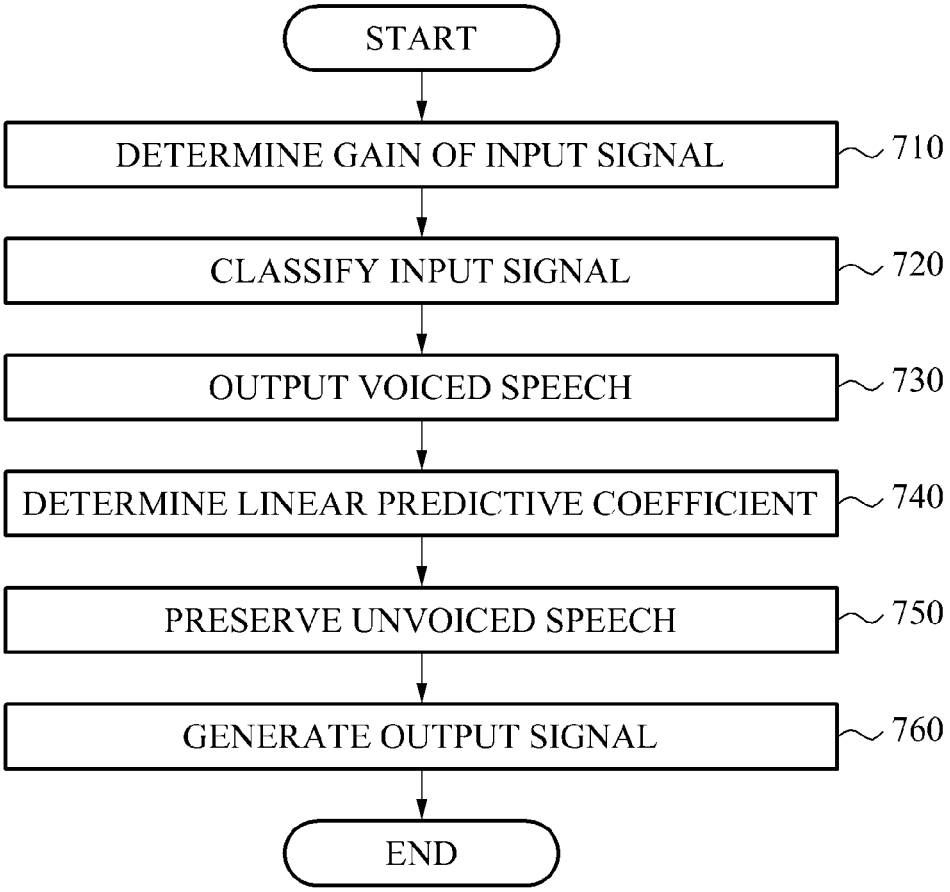
FIG. 7 is a flowchart illustrating an example of a speech signal processing method.

FIG. 7 is a flowchart illustrating an example of a speech signal processing method.

In 710, the method determines a gain of an input signal using a comb filter based on a harmonic characteristic of a voiced speech. For example, the input signal gain determiner 110 of FIG. 1 determines a gain of an input signal using a comb filter based on a harmonic characteristic of a voiced speech. In such an example, the comb filter is a function having a frequency response in which spikes repeat at regular intervals. In an example, the input signal is a speech signal collected by a microphone of a hearing loss compensation apparatus.

In 720, the method classifies the input signal into a voiced speech and an unvoiced speech. For example, the input signal classifier 120 of FIG. 1 classifies the input signal into a voiced speech and an unvoiced speech. In such an example, the input signal classifier 120 determines whether a present frame of the input signal is a noise section using a voiced and unvoiced speech discriminator and/or a VAD. When the present frame is not the noise section, the input signal classifier 120 classifies a speech included in the present frame as the voiced speech or the unvoiced speech.

In 730, the method generates a voiced speech in which a harmonic component is preserved by applying the gain determined by the input signal gain determiner 110 to the input signal. For example, voiced speech output unit 130 of FIG. 1 generates a voiced speech in which a harmonic component is preserved by applying the gain determined by the input signal gain determiner 110 to the input signal. In such an example, the voiced speech in which the harmonic component is preserved is the voiced speech of the input signal classified in operation 720.

In such an example, the voiced speech output unit 130 outputs the voiced speech in which the harmonic component is preserved by generating an intermediate output signal by applying the gain determined by the input signal gain determiner 110 to the input signal and by performing an ISTFT or an IFFT on the intermediate output signal.

In 740, the method determines a linear predictive coefficient to be used by the unvoiced speech preserver 150 of FIG. 1 based on the voiced speech output in operation 730. For example, the linear predictive coefficient determiner 140 of FIG. 1 determines a linear predictive coefficient to be used by the unvoiced speech preserver 150 of FIG. 1 based on the voiced speech output in operation 730.

In 750, the method configures an all-pole filter based on the linear predictive coefficient determined in operation 740, and preserves the unvoiced speech of the input signal using the all-pole filter. For example, the unvoiced speech preserver 150 configures an all-pole filter based on the linear predictive coefficient determined in operation 740, and preserves the unvoiced speech of the input signal using the all-pole filter. In such an example, the all-pole filter uses a residual spectrum of a target speech signal included in the input signal as excitation signal information input to the all-pole filter.

In 760, the method generates a speech output signal based on the voiced speech output in operation 730 and the unvoiced speech output in operation 750. For example, the output signal generator 160 of FIG. 1 generates a speech output signal based on the voiced speech output in operation 730 and the unvoiced speech output in operation 750.

In such an example, the output signal generator 160 generates the speech output signal based on the voiced speech in which the harmonic component is preserved in a section in which a ZCR of the input signal is less than a threshold value. Accordingly, the output signal generator 160 generates the speech output signal based on the preserved unvoiced speech in a section in which the ZCR of the input signal is greater than or equal to the threshold value.

Also, in another example, the speech signal processing method processes a speech signal based on different characteristics between the voiced speech and the unvoiced speech. Accordingly, the speech signal processing method enhances speech intelligibility by effectively reducing background noise and at the same time, effectively preserving harmonic components of the voiced sound and unvoiced speech components having a characteristic of white noise.

Figure 8:
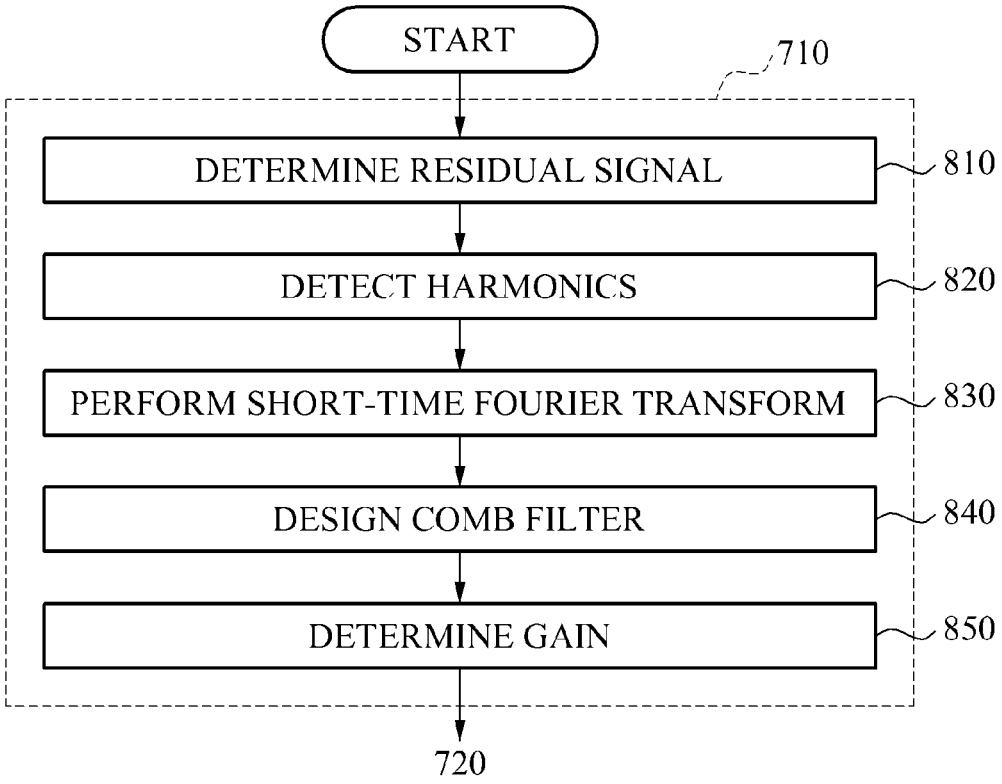
FIG. 8 is a flowchart illustrating an example of a process of determining a gain of an input signal.

FIG. 8 is a flowchart illustrating an example of a process of determining a gain of an input signal. Operations 810 through 850 to be described with reference to FIG. 8 are included in an example of operation 710, as described with reference to FIG. 7.

In 810, the method determines a residual signal of the input signal using a linear predictor. For example, the residual signal determiner 210 of FIG. 2 determines a residual signal of the input signal using a linear predictor.

In 820, the method detects a harmonic component in a spectral domain of the residual signal determined in operation 810. For example, the harmonic detector 220 of FIG. 2 detects a harmonic component in a spectral domain of the residual signal determined in operation 810.

In 830, the method performs an STFT on each of the input signal and the residual signal determined in operation 810, and outputs an input spectrum and a residual signal spectrum. For example, short-time Fourier transformer 230 of FIG. 2 performs an STFT on each of the input signal and the residual signal determined in operation 810, and outputs an input spectrum and a residual signal spectrum.

In 840, the method designs a comb filter based on the harmonic component detected in operation 820. For example, the comb filter designer 240 of FIG. 2 designs a comb filter based on the harmonic component detected in operation 820. In such an example, the comb filter designed by the comb filter designer 240 is a function having a frequency response in which spikes repeat at regular intervals, and be effective in restoring harmonic components repeating at regular intervals.

In 850, the method determines a gain of the input signal based on a Wiener filter gain obtained as a result of filtering the input spectrum output in operation 830 using a Wiener filter and on a comb filter gain obtained as a result of filtering the residual signal spectrum output in operation 830 using the comb filter designed in operation 840. For example, the gain determiner 250 of FIG. 2 determines a gain of the input signal based on a Wiener filter gain obtained as a result of filtering the input spectrum output in operation 830 using a Wiener filter and on a comb filter gain obtained as a result of filtering the residual signal spectrum output in operation 830 using the comb filter designed in operation 840. For example, the Wiener filter gain is obtained using a single channel speech enhancement algorithm.

Figure 9:
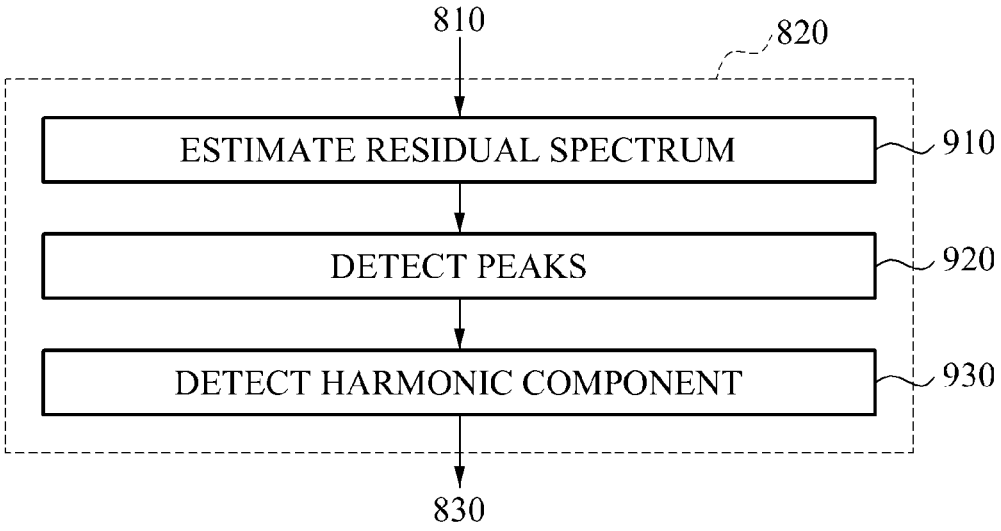
FIG. 9 is a flowchart illustrating an example of a harmonic detecting process.

FIG. 9 is a flowchart illustrating an example of a harmonic detecting process. Operations 910 through 930 to be described with reference to FIG. 9 are included in an example of operation 820 described with reference to FIG. 8.

In 910, the method estimates a residual spectrum of a target speech signal included in an input signal in a spectral domain of the residual signal determined in operation 810 described with reference to FIG. 8. For example, residual spectrum estimator 310 of FIG. 3 estimates a residual spectrum of a target speech signal included in an input signal in a spectral domain of the residual signal determined in operation 810 described with reference to FIG. 8.

In 920, the method detects peaks in the residual spectrum estimated in operation 910 using an algorithm for peak detection. For example, the peak detector 320 of FIG. 3 detects peaks in the residual spectrum estimated in operation 910 using an algorithm for peak detection.

In 930, the method detects a harmonic component based on an interval between the peaks detected in operation 920. For example, harmonic component detector 330 of FIG. 3 detects a harmonic component based on an interval between the peaks detected in operation 920.

In one example scenario for applying the method, when the interval between the peaks detected by the peak detector 320 is less than $0.7\ k_0$, the harmonic component detector 330 consider the peaks detected by the peak detector 320 to be peaks formed by noise. Also, the harmonic component detector 330 optionally deletes the peaks considered to be formed by noise, from among the peaks detected in operation 920.

When the interval between the peaks detected by the peak detector 320 is greater than $1.3\ k_0$, the harmonic component detector 330 considers that disappearing harmonics may be present between the peaks detected by the peak detector 320 and detects disappearing harmonic components using an integer multiple of a fundamental frequency.

A speech signal processing apparatus and method described herein enhance speech intelligibility by processing a speech signal based on different characteristics for a voiced speech and an unvoiced speech, and effectively reducing background noise while effectively preserving harmonic components of the voiced speech and unvoiced speech components having a characteristic of white noise.

The apparatuses and units described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciate that a processing device may include multiple processing elements and multiple types of processing elements. For example, a hardware component may include multiple processors or a processor and a controller. In addition, different processing configurations are possible, such as parallel processors.

The methods described above can be written as a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device that is capable of providing instructions or data to or being interpreted by the processing device. The software also may be distributed over network coupled computer systems so that the software is stored and executed in a distributed fashion. In particular, the software and data may be stored by one or more non-transitory computer readable recording mediums. The media may also include, alone or in combination with the software program instructions, data files, data structures, and the like. The non-transitory computer readable recording medium may include any data storage device that can store data that can be thereafter read by a computer system or processing device. Examples of the non-transitory computer readable recording medium include read-only memory (ROM), random-access memory (RAM), Compact Disc Read-only Memory (CD-ROMs), magnetic tapes, USBs, floppy disks, hard disks, optical recording media (e.g., CD-ROMs, or DVDs), and PC interfaces (e.g., PCI, PCI-express, WiFi, etc.). In addition, functional programs, codes, and code segments for accomplishing the example disclosed herein can be construed by programmers skilled in the art based on the flow diagrams and block diagrams of the figures and their corresponding descriptions as provided herein.

As a non-exhaustive illustration only, a terminal/device/unit described herein may refer to mobile devices such as, for example, a cellular phone, a smart phone, a wearable smart device (such as, for example, a ring, a watch, a pair of glasses, a bracelet, an ankle bracket, a belt, a necklace, an earring, a headband, a helmet, a device embedded in the cloths or the like), a personal computer (PC), a tablet personal computer (tablet), a phablet, a personal digital assistant (PDA), a digital camera, a portable game console, an MP3 player, a portable/personal multimedia player (PMP), a handheld e-book, an ultra mobile personal computer (UMPC), a portable lab-top PC, a global positioning system (GPS) navigation, and devices such as a high definition television (HDTV), an optical disc player, a DVD player, a Blu-ray player, a setup box, or any other device capable of wireless communication or network communication consistent with that disclosed herein. In a non-exhaustive example, the wearable device may be self-mountable on the body of the user, such as, for example, the glasses or the bracelet. In another non-exhaustive example, the wearable device may be mounted on the body of the user through an attaching device, such as, for example, attaching a smart phone or a tablet to the arm of a user using an armband, or hanging the wearable device around the neck of a user using a lanyard.

A computing system or a computer may include a microprocessor that is electrically connected to a bus, a user interface, and a memory controller, and may further include a flash memory device. The flash memory device may store N-bit data via the memory controller. The N-bit data may be data that has been processed and/or is to be processed by the microprocessor, and N may be an integer equal to or greater than 1. If the computing system or computer is a mobile device, a battery may be provided to supply power to operate the computing system or computer. It will be apparent to one of ordinary skill in the art that the computing system or computer may further include an application chipset, a camera image processor, a mobile Dynamic Random Access Memory (DRAM), and any other device known to one of ordinary skill in the art to be included in a computing system or computer. The memory controller and the flash memory device may constitute a solid-state drive or disk (SSD) that uses a non-volatile memory to store data.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A speech signal processing apparatus, comprising:

an input signal gain determiner configured to determine a gain of an input signal using a comb filter based on a detected harmonic component in the input signal;

a voiced speech output unit configured to output voiced speech in which a harmonic component is preserved by applying the gain to the input signal;

a linear predictive coefficient determiner configured to determine a linear predictive coefficient based on the voiced speech; and an unvoiced speech preserver configured to preserve an unvoiced speech of the input signal based on the linear predictive coefficient, wherein the voiced speech output unit is configured to output the voiced speech by generating an intermediate output signal by applying the gain to the input signal and performing an inverse short-time Fourier transform (ISTFT) or an inverse fast Fourier transform (IFFT) on the intermediate output signal, and the input signal gain determiner comprises a residual signal determiner configured to determine a residual signal of the input signal using a linear predictor, a harmonic detector configured to detect the harmonic component in a spectral domain of the residual signal, a comb filter designer configured to design the comb filter based on the detected harmonic component, and a gain determiner configured to determine the gain based on a result of filtering the input signal using a Wiener filter and a result of filtering the input signal using the comb filter.

2. The apparatus of claim 1, wherein the harmonic detector comprises:

a residual spectrum estimator configured to estimate a residual spectrum of a target speech signal comprised in the input signal in the spectral domain of the residual signal;

a peak detector configured to detect peaks in the residual spectrum estimated using an algorithm for peak detection; and a harmonic component detector configured to detect the harmonic component based on an interval between the detected peaks.

3. The apparatus of claim 1, wherein the comb filter is a function having a frequency response in which spikes repeat at regular intervals.

4. The apparatus of claim 1, wherein the linear predictive coefficient determiner is configured to classify the voiced speech into a linear combination of coefficients and a residual signal, and to determine the linear predictive coefficient based on the linear combination of the coefficients.

5. The apparatus of claim 1, wherein the unvoiced speech preserver is configured to preserve an unvoiced speech of the input signal using an all-pole filter based on the linear predictive coefficient.

6. The apparatus of claim 5, wherein the all-pole filter is configured to use a residual spectrum of a target speech signal comprised in the input signal as excitation signal information input to the all-pole filter.

7. The apparatus of claim 1, further comprising:

an output signal generator configured to generate a speech output signal based on a section of the input signal, the voiced speech and the unvoiced speech.

8. The apparatus of claim 7, wherein the output signal generator is configured to generate the speech output signal based on the voiced speech in a section of the input signal in which a zero-crossing rate (ZCR) of the input signal is less than a threshold value, and to generate the speech output signal based on the unvoiced speech in a section of the input signal in which the ZCR of the input signal is greater than or equal to the threshold value.

9. A speech signal processing method, comprising:

determining a gain of an input signal using a comb filter based on a detected harmonic component in the input signal;

outputting the voiced speech in which a harmonic component is preserved by applying the gain to the input signal;

determining a linear predictive coefficient based on the voiced speech; and preserving an unvoiced speech of the input signal based on the linear predictive coefficient, wherein the outputting of the voiced speech comprises generating an intermediate output signal by applying the gain to the input signal, and performing an inverse short-time Fourier transform (ISTFT) or an inverse fast Fourier transform (IFFT) on the intermediate output signal, and the determining of the gain of the input signal comprises determining a residual signal of the input signal using a linear predictor, detecting the harmonic component in a spectral domain of the residual signal, designing the comb filter based on the detected harmonic component, and determining the gain based on a result of filtering the input signal using a Wiener filter and a result of filtering the input signal using the comb filter.

10. The method of claim 9, wherein the detecting of the harmonic component comprises:

estimating a residual spectrum of a target speech signal comprised in the input signal in the spectral domain of the residual signal;

detecting peaks in the residual spectrum estimated using an algorithm for peak detection; and detecting the harmonic component based on an interval between the detected peaks.

11. The method of claim 9, wherein the comb filter is a function having a frequency response in which spikes repeat at regular intervals.

12. The method of claim 9, wherein the determining of the linear predictive coefficient comprises:

classifying the voiced speech into a linear combination of coefficients and a residual signal; and determining the linear predictive coefficient based on the linear combination of the coefficients.

13. The method of claim 9, wherein the preserving comprises preserving an unvoiced speech of the input signal using an all-pole filter based on the linear predictive coefficient.

14. The method of claim 13, wherein the all-pole filter is configured to use a residual spectrum of a target speech signal comprised in the input signal as excitation signal information input to the all-pole filter.

15. The method of claim 9, further comprising:

generating a speech output signal based on a section of the input signal, the voiced speech and the unvoiced speech.

16. The method of claim 15, wherein the generating of the speech output signal comprises:

generating the speech output signal based on the voiced speech in a section of the input signal in which a zero-crossing rate (ZCR) of the input signal is less than a threshold value; and generating the speech output signal based on the unvoiced speech in a section of the input signal in which the ZCR of the input signal is greater than or equal to the threshold value.

17. A non-transitory computer-readable storage medium storing instructions that, when executed by a processor, cause the processor to perform the method of claim 9.

* * * * *